US007651416B2

(12) United States Patent
Farquhar

(10) Patent No.: US 7,651,416 B2
(45) Date of Patent: Jan. 26, 2010

(54) GOAL TENDING DEVICE

(75) Inventor: Tim Farquhar, Richmond Hill (CA)

(73) Assignee: Roalie Inc., Richmond Hill, Ontario ( * ) Notice: Subject to any disclaimer, the term of this patent is extended or adjusted under 35 U.S.C. 154(b) by 338 days.

(21) Appl. No.: 11/746,441

(22) Filed: May 9, 2007

(65) Prior Publication Data

US 2007/0265115 A1 Nov. 15, 2007

(30) Foreign Application Priority Data

May 10, 2006 (CA) ..... 2546037

(51) Int. Cl.
*A63B 69/00* (2006.01)

(52) U.S. Cl. ..... 473/446; 273/398

(58) Field of Classification Search ..... 473/422, 473/478, 446; 383/20, 72; 273/398
See application file for complete search history.

(56) References Cited

U.S. PATENT DOCUMENTS

| | | | | | |
|---|---|---|---|---|---|
| 733,542 | A | * | 7/1903 | Converse | 383/16 |
| 1,677,583 | A | * | 7/1928 | Cromwell, Jr. | 383/20 |
| 2,380,266 | A | * | 7/1945 | Roth | 450/26 |
| 2,932,516 | A | | 4/1960 | Penner | |
| 3,837,650 | A | | 9/1974 | Haney | |
| 3,856,298 | A | * | 12/1974 | Frantti | 473/446 |
| 4,186,689 | A | * | 2/1980 | Alexander et al. | 119/725 |
| 4,921,257 | A | * | 5/1990 | Heller | 473/446 |
| 6,467,955 | B1 | * | 10/2002 | Kim | 383/20 |
| 2005/0200079 | A1 | * | 9/2005 | Barber | 273/400 |
| 2007/0281807 | A1 | * | 12/2007 | Cho | 473/478 |

FOREIGN PATENT DOCUMENTS

| | | |
|---|---|---|
| CA | 976577 | 10/1975 |
| CA | 1057325 | 6/1979 |
| CA | 1227818 | 10/1987 |
| CA | 2019338 | 12/1991 |
| CA | 2141228 | 4/1996 |
| CA | 2160746 | 7/1996 |
| CA | 2244033 | 1/2000 |
| CA | 2293979 | 7/2001 |

* cited by examiner

*Primary Examiner*—Gene Kim
*Assistant Examiner*—M Chambers
(74) *Attorney, Agent, or Firm*—Jenna L. Wilson; Dimock Stratton LLP

(57) ABSTRACT

An apparatus for mounting on a goal is provided for assisting in scoring and target practice. The apparatus is preferably formed of a laminate fabric that is capable of being printed or decorated on at least one side, and is provided with at least one target area that allows a projectile, such as a puck or ball, to pass through the apparatus and into a goal when the apparatus is mounted on a goal. A network of reinforcement means is fixed on a rear surface of the apparatus in a manner that frames each of the target areas. A plurality of tethering means with length adjustment means is provided, preferably extending from and integral some of the reinforcement means. The apparatus is provided with an attached jacket, such that the apparatus can be stowed by rolling it into a scroll-like form and wrapping it with the jacket.

14 Claims, 8 Drawing Sheets

GOAL TENDING DEVICE

FIELD OF THE INVENTION

The present invention relates generally to sporting equipment, and in particular to a target for use in goal scoring practice.

TECHNICAL BACKGROUND

It is generally desirable that participants in a sport practice their skills. In particular, it is desirable that participants in a sport requiring that a projectile, such as a puck or ball, be shot, driven, thrown, or otherwise propelled into a goal area, practice their aiming skills with reference to the goal area. The goal area is generally defined as a two-dimensional region through which the projectile must pass to be counted towards a player's score; the region may be defined by markers, posts, or a frame around two or more sides of the two-dimensional area. The space behind the goal may be blocked by a net, mesh, board, or other means to prevent a projectile from travelling too far beyond the goal area.

An individual player may practice his or her goal-scoring skills equipped with a projectile playing piece, equipment to be used in propelling the projectile, and a goal; for example, in the sport of hockey, a solo player may practice scoring goals on an empty goal with a puck and a hockey stick. However, in some sports the goal area is protected by a goaltender, whose role is to block the projectile from entering the goal area. Scoring a goal by propelling the projectile into the goal area, therefore, presents more of a challenge than is available in solo practice, because portions of the goal area are blocked. Even for those sports participants whose interest is more recreational than competitive, solo practice in this fashion may present an insufficient challenge to maintain the participant's interest.

Therefore, it is desirable to provide a means to increase the challenge of solo recreational or competitive sports practice.

BRIEF DESCRIPTION OF THE DRAWINGS

In drawings which illustrate by way of example only a preferred embodiment of the invention.

DETAILED DESCRIPTION OF THE INVENTION

Figure 1:
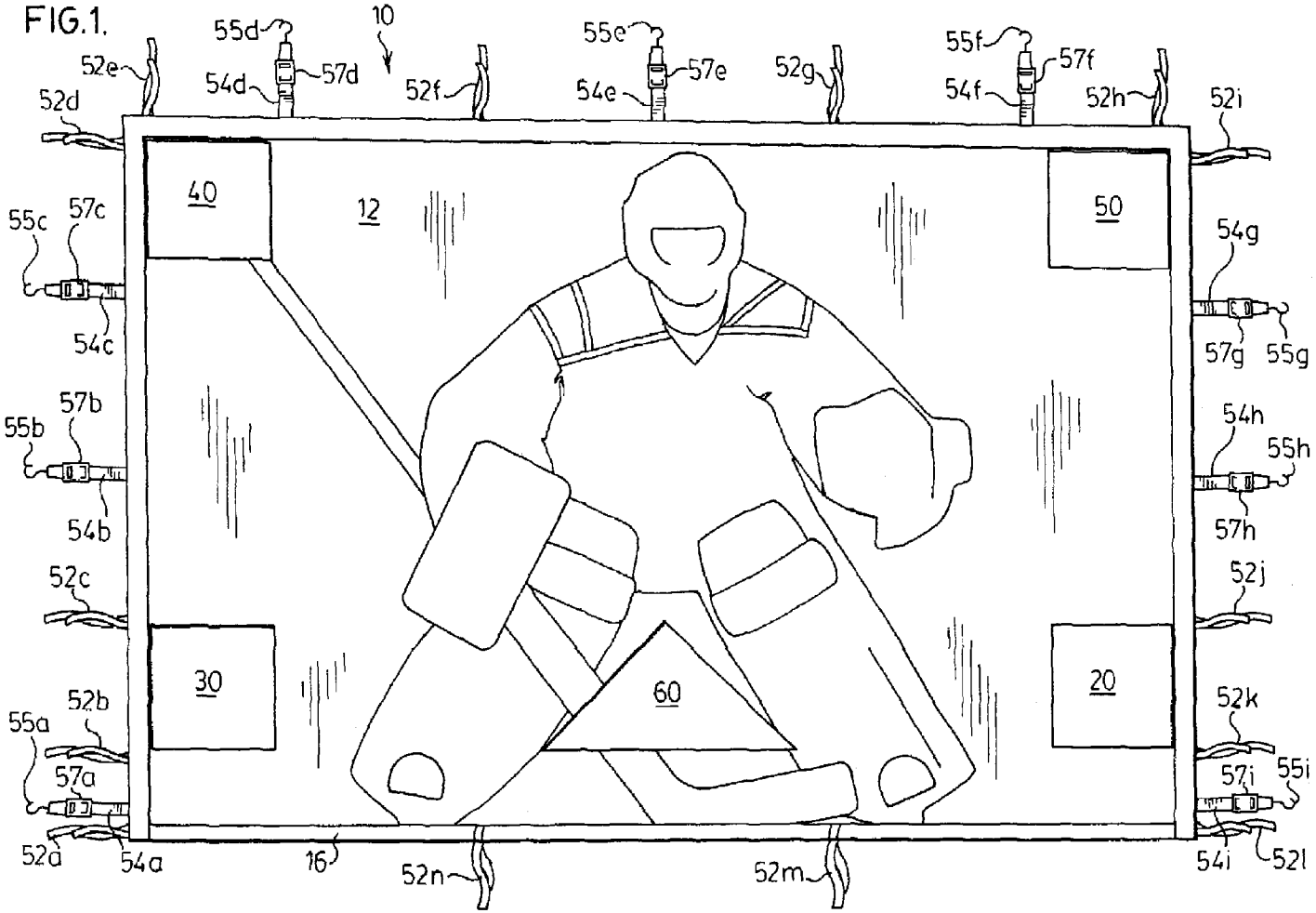
FIG. 1 is a front elevation of a goal tending device.
Figure 2:
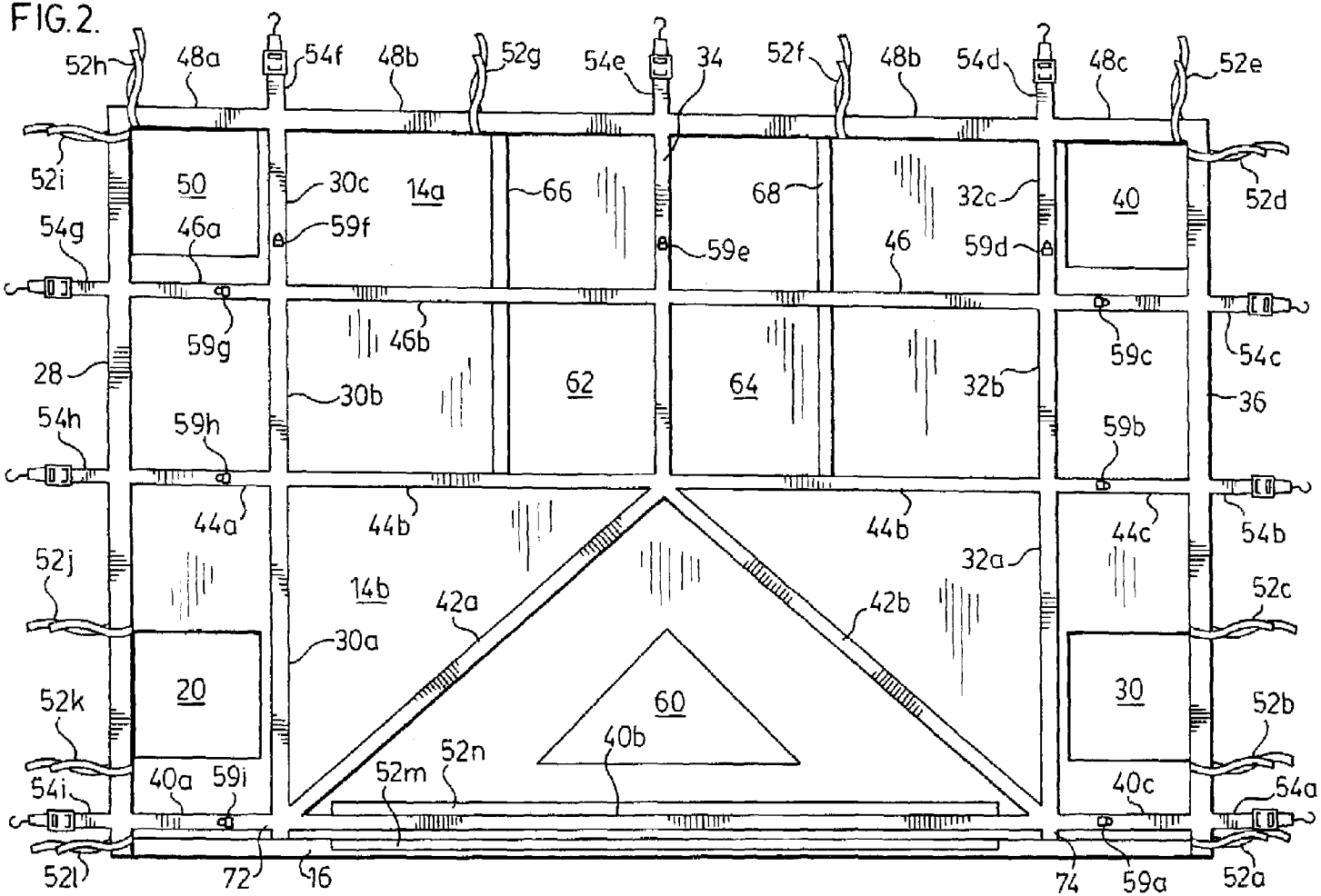
FIG. 2 is a rear elevation of the goal tending device of FIG. 1.

Referring to FIGS. 1 and 2, there is provided a goal tending device 10. The goal tending device preferably comprises an integral panel having a front surface 12 and a rear surface 14*a*, 14*b*. The integral panel is preferably formed of a laminate material, such as a nylon fabric with a polyurethane backing. Most preferably, the material selected for the panel should be capable of withstanding an impact of a hockey puck or other projectile, such as a ball, travelling at approximately 80 km/h, preferably an impact from a projectile having a momentum of approximately 13.2 kg·m/s, and most preferably a momentum in excess of 25 kg·m/s. In one embodiment, a nylon material with a polyurethane backing, having a thickness of 1680 deniers is used. Most preferably, a material with a sufficient thickness to withstand the impact of a puck travelling at 160 km/h is used, although the skilled worker may select a material with appropriate characteristics according to the intended use of the goal tending device 10, for example depending on whether the device 10 is intended be used with less skilled players not capable of propelling a puck, ball, or other projectile over 100 km/h. The front surface 12 is preferably capable of being printed, silk-screened, or similarly decorated with graphics or other information, which may include advertising, sponsorship information, or as shown in FIG. 1, a depiction of a goaltender. The goal tending device 10 is preferably shaped and sized to cover substantially the entire open area of a regulation-sized goal, for example a generally rectangular hockey goal sized in accordance with National Hockey League® regulations, if the goal tending device 10 is intended for use in hockey practice. In the most preferred embodiment, the goal tending device 10 has a horizontal dimension of 76.75 inches (194.95 cm) and a vertical dimension 50.375 inches (127.95 cm), excluding the tethering means 54*a* . . . *n* and tie means 52*a* . . . *n*, described below. The goal tending device 10 may, of course, be sized smaller to fit recreational goals. While ideally the panel of the goal tending device 10 is formed of an integral sheet of laminate or canvas, in further embodiments it may be constructed of a plurality of laminate or canvas pieces, seamed or otherwise joined with seams or adhesives of sufficient strength to ensure that the goal tending device 10 can withstand the impact of a hockey puck or other similar projectile.

Figure 5A:
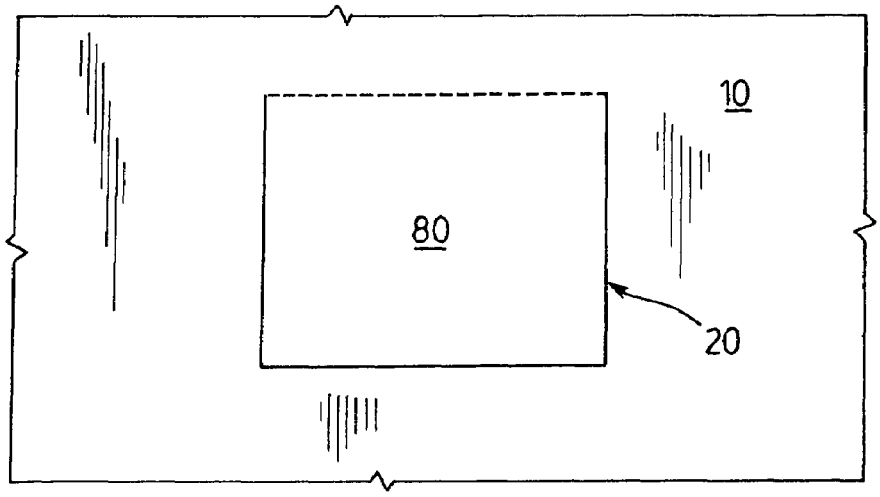
FIGS. 5*a* and 5*b* are front elevations of further embodiments of a target area for a goal tending device.
Figure 5B:
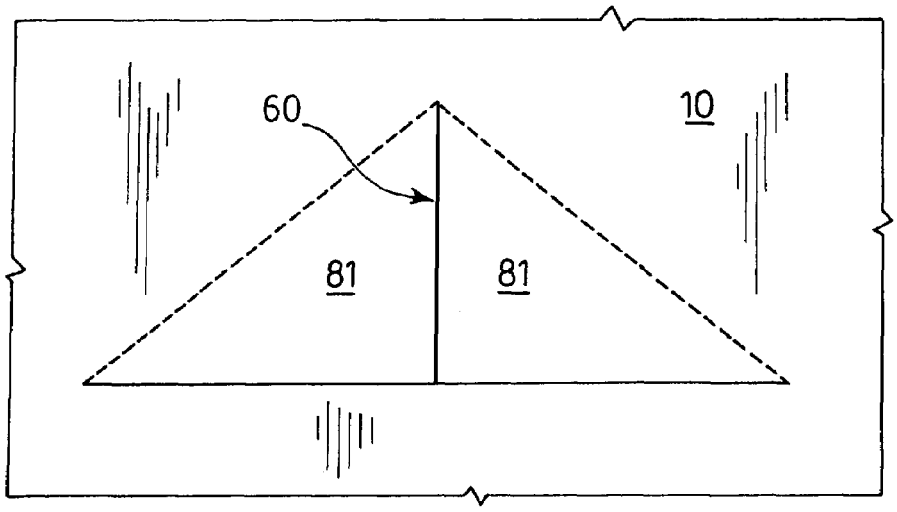

The goal tending device 10 is provided with at least one target area. In the preferred embodiment, target areas 20, 30, 40, 50 are provided near the corners of the goal tending device 10, and are preferably generally rectangular in shape, most preferably 8 inches (20 cm) square. In a most preferred embodiment, the target areas 20, 30, 40, 50 are formed by cutting the integral panel of the goal tending device 10 around all edges of the intended target region, thus leaving voids defining the target areas 20, 30, 40, 50. With reference to FIG. 5*a*, alternatively the target area 20, 30, 40, 50 may be provided with a flap means by providing an incision in the goal tending device 10 along three of the four edges defining a generally rectangular target region, leaving a flap 80 having the shape of the target area 20, 30, 40, 50 depending downward when the goal tending device 10 is erected and in use on a goal. The area of the device 10 near the remaining edge, indicated as a dotted line in FIG. 5*a*, provides a hinge means for allowing the flap 80 to move in response to an impact. The goal tending device 10 also preferably comprises a further target area 60, which is most preferably generally triangularly shaped as shown in FIGS. 1 and 2, and is formed by cutting the panel of the goal tending device 10 around all edges of the intended target region, leaving a void. In an alternative embodiment as shown in FIG. 5*b*, the target area 60 may be formed by incisions along two line segments as shown, thus defining flaps 81 filling the region of the target area 60. Similarly, the areas of the device 10 near the edges indicated as dotted lines in FIG. 5*b* provide a hinge means for the flaps 81 to move in response to an impact.

Figure 4:
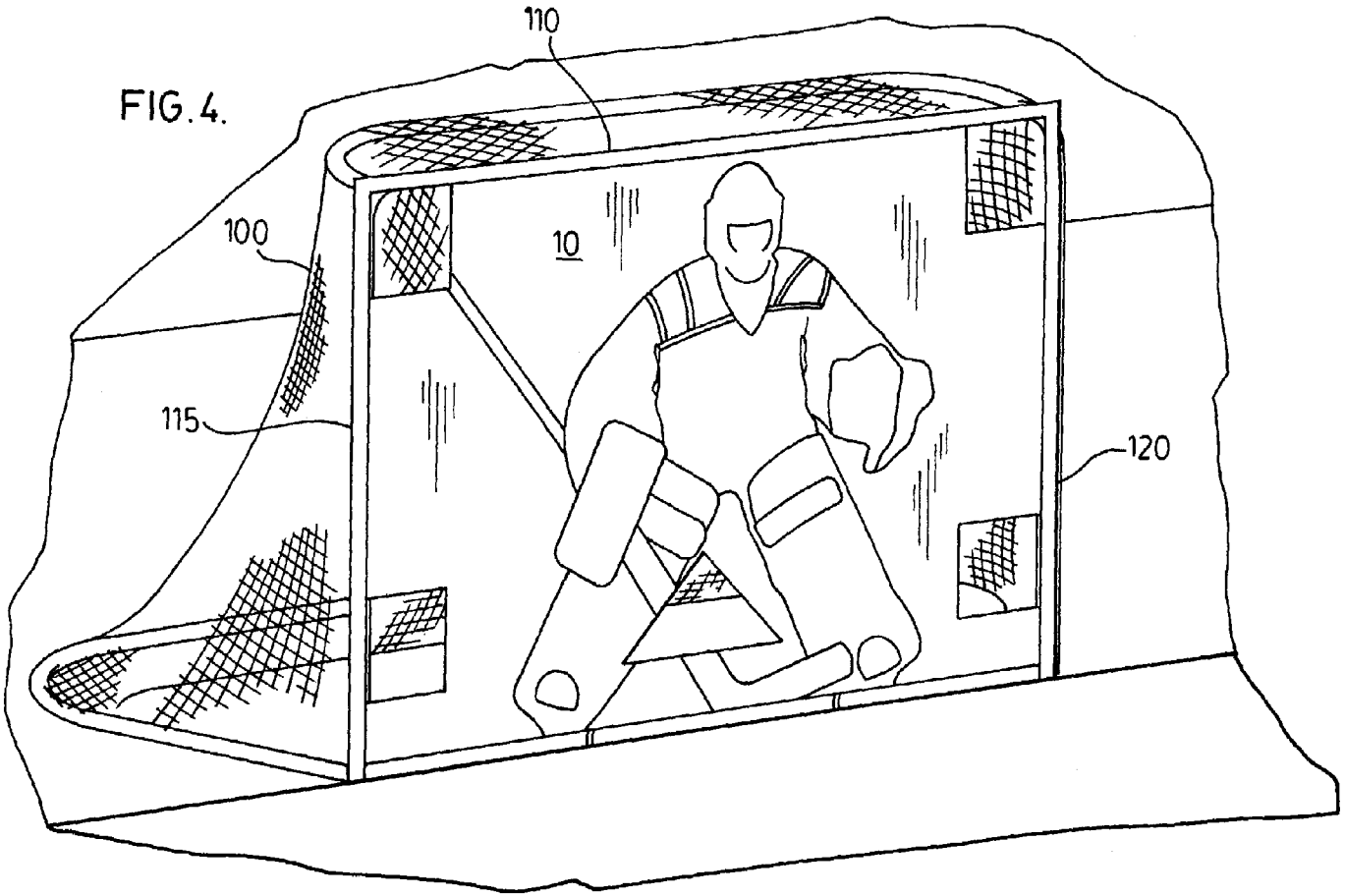
FIG. 4 is a perspective view of a goal tending device mounted on a hockey goal structure.

It will be appreciated that the target areas 20, 30, 40, 50, 60 may have any size or shape, but preferably these target areas are sized, shaped, and positioned on the goal tending device 10 in a manner that presents the most suitable challenge to the user; for example, the positions of target areas 40, 50 are provided in the region that is generally referred to as a "top drawer" position in hockey, being positioned at the highest point of the hockey goal 100 (as shown in FIG. 4) and requiring skill in aiming a puck or other projectile, since the puck or other projectile may miss the target area 40, 50 and strike a crossbar (not shown) of the goal 100 instead. The size of the target area 20, 30, 40, 50, 60 may be chosen to test the skill of a user, a smaller area being, of course, more difficult to strike. The shape of the target area 60 is preferably chosen to simulate a vulnerability associated with hockey goaltending, between the leg pads of a hockey goaltender but above the blade of the goaltender's hockey stick. The decorative graphics provided in FIG. 1 illustrate the placement of this vulnerable region. In one embodiment, the target areas 20, 30, 40, 50 are approximately 8 inches (20 cm) square, and the target area 60 is a generally isosceles triangle with a base of approximately 17 inches (43.2 cm) and a height of 8.5 inches (21.6 cm); the lower edge of the target areas 20, 30, 60 are preferably 6 inches (15 cm) above the lower edge of the goal tending device 10. The generally triangular target area 60 is preferably centred on the goal tending device 10. The upper and outer edges of the target areas 40, 50 are preferably adjacent the reinforcement means 36, 48*c* and 28, 48*a*, respectively. The outer edges of the target areas 20, 30 are preferably adjacent the reinforcement means 28, 36 respectively. The reinforcement means are generally described below.

Referring to FIG. 2, a plurality of reinforcement means are provided on the rear surface 14*a*, 14*b* of the goal tending device 10. The rear surface 14*a*, 14*b* is preferably an integrally-formed surface; the designation of the surface as portions 14*a* and 14*b* is for the purpose of describing a method of stowing the goal tending device 10, below. The reinforcement means are preferably formed of a webbing or strip of reinforcement material, preferably nylon or other suitable fiber, and are attached to the goal tending device 10 by an adhesive, or alternatively by stitching, through the reinforcement means and the goal tending device 10; if stitching is used, then the attachment means may be visible on the front surface 12 of the goal tending device 10. In a preferred embodiment, the reinforcement means comprise nylon straps that are double-stitched to the panel, and most preferably are approximately 2 inches (5 cm) in width. Some reinforcement means may be wider to provide additional support, particularly around the triangular target area 60.

Preferably, the goal tending device 10 is provided with reinforcement means disposed at or near the edges of the device 10. As shown in FIG. 4, a reinforcement means 28, 36 is provided along the side edges of the device 10, and further reinforcement means 40*a*, 40*b*, 40*c* and 48*a*, 48*b*, 48*c* are provided along the remaining edges of the goal tending device 10. Preferably, reinforcement means 48*a*, 48*b*, 48*c* is disposed at the upper edge of the device 10, while the reinforcement means 40*a*, 40*b*, 40*c* is disposed above the lower edge of the device 10, thus defining a skirt 16 of unreinforced material at the lower edge of the goal tending device 10. Most preferably, the reinforcement means 40*a*, 40*b*, 40*c* and 48*a*, 48*b*, 48*c* are provided as two separate, integral reinforcement means, for example such that the reinforcement means 40*a*, 40*b*, 40*c* is an integral piece, and not subdivided into a plurality of reinforcement segments.

Further reinforcement means 44*a*, 44*b*, 44*c* and 46*a*, 46*b*, 46*c* are also provided and positioned such that they are substantially parallel to the reinforcement means 40*a*, 40*b*, 40*c*; and reinforcement means 30*a*, 30*b*, 30*c*; 34; and 32*a*, 32*b*, 32*c* are provided and oriented such that they are substantially parallel to the reinforcement means 28.

Again, preferably the reinforcement means 44*a*, 44*b*, 44*c*; 46*a*, 46*b*, 46*c*; 30*a*, 30*b*, 30*c*; and 32*a*, 32*b*, 32*c* are provided as integral reinforcement means, and are not composed of separate reinforcement segments. As can be seen from FIG. 2, preferably all of the aforementioned reinforcement means, with the exception of reinforcement means 34, extend substantially from edge to edge of the goal tending device 10; in the most preferred embodiment, the reinforcement means extend into a number of tethers 54*a* . . . *n*, described below.

Reinforcement means 34 preferably extends along a portion of the rear surface of the goal tending device 10, and most preferably along the upper portion of the rear surface 14*a*, and preferably is generally aligned with the uppermost vertex of the target area 60, if the target area 60 is provided with a triangular shape. The reinforcement means 34 preferably intersects or meets the reinforcement means 44*b*, as well as two further reinforcement means 42*a*, 42*b*, which extend from the means 34 to the reinforcement means 40*b*. In the most preferred embodiment, reinforcement means 42*a*, 40*b*, 40*a*, and 30*a* meet at a junction 72; the reinforcement means 42*b*, 40*b*, 40*c*, and 32*a* meet at a junction 74. At the junctions 72, 74, some or all of the reinforcement means may overlap, resulting in a double or greater thickness of reinforcement means at those junctions. In an alternate embodiment, a further reinforcement means (not shown) may be provided substantially parallel to the reinforcement means 44*b*, extending between reinforcement means 30*a* and 32*a* or 28 and 36, positioned at the upper edge of the target areas 20, 30 and the upper vertex of the target area 60.

The reinforcement means described above thus defines a network of reinforcement on the surface of the goal tending device 10 that serves to both reinforce the device 10, and to further define the regions in which target areas 20, 30, 40, 50 and 60 are disposed. It can be seen, for example, that reinforcement means 42*a*, 42*b*, and 40*b* frame the target area 60; the reinforcement means 46*a*, 28, 48*a*, and 30*c* frame the target area 50, and so on. The area surrounding each of the target areas 20, 30, 40, 50, 60 is thus supported by their respective reinforcement means.

The goal tending device 10 is further provided with tethering means 54*a* . . . *n*, as shown in FIG. 2. Most preferably, the tethering means comprise extensions of the reinforcement means beyond the dimensions of the goal tending device 10. For example, tethering means 54*a* is preferably an extension of the reinforcement means 40*c*, and tethering means 541 is preferably an extension of the reinforcement means 40*a*; also, most preferably, the reinforcement means 40*a*, 40*b*, 40*c* are a unitary reinforcement means, such that the ensemble of tethering means 54*i*, reinforcement means 40*a*, 40*b*, 40*c*, and tethering means 54*a*, comprises an integral reinforcement means, and similarly for the remaining tethering means and the corresponding adjacent and colinear reinforcement means. If the tethering means 54*a* . . . *n* are separate means, they are preferably joined to the goal tending device surface 14*a* or 14*b* by a similar means as the reinforcement means, for example by double stitching.

Each of the tethering means 54*a* . . . *n* is preferably provided with a length adjustment means 57*a* . . . *n*, which may comprise a cam lock or a ladder lock, or similar devices known in the art for adjusting the lengths of bands formed of webbing and the like. The tethering means 54*a* . . . *n* are further provided with a fastening means, such as a hook means 55*a* . . . *n* and an eye means 59*a* . . . *n*, or other appropriate hook, clip, buckle, D-ring, or loop means. The attachment of such fastening means, as well as the length adjustment means 57*a* . . . *n*, is generally known in the art. For example, a first portion of the length adjustment means 57*a* . . . *n* may be threaded onto the tethering means 54*a* . . . *n*; next, the hook or other fastening means 55*a* . . . *n* may be threaded onto the tethering means 54*a* . . . *n*; then the tethering means 54*a* . . . *n* may be doubled and its end threaded back through another portion of the length adjustment means 57*a* . . . *n*. The remaining portion of the fastener means, such as the eye means 59*a* . . . *n*, is attached to a reinforcement means generally aligned with the tethering means 54*a* . . . *n*, such that the tethering means 54*a* . . . *n* may be doubled back and fastened to the reinforcement means.

The goal tending device 10 is also preferably provided with a jacket means 62, 64. The jacket means generally comprises a first substantially rectangular portion 62, and a second substantially rectangular portion 64, each attached to the goal tending device 10 along an edge, most preferably along the reinforcement means 34. The jacket means 62, 64 may be provided as an integral piece, formed of the same material as the goal tending device 10, and may be attached by centering the jacket means 62, 64 on the goal tending device; laying the reinforcement means 34 over the jacket means 62, 64 and the goal tending device 10; and stitching through all layers, although the components may be alternatively adhered individually to the goal tending device 10. Most preferably, the vertical length of the reinforcement means 34 and of the jacket means 62, 64 is half the dimension of the goal tending device. The width of the jacket means 62, 64 is determined by the thickness of the material forming the goal tending device 10, as will be understood by those skilled in the art in the discussion of a stowing method, below. A face of the jacket means 62 is provided with a fastener means 66, such as the loop means of a hook-and-loop fastener, on an outer edge. The jacket means 64 is likewise provided with a fastener means 68 such as the hook means of a hook-and-loop fastener on an outer edge, on a face opposing the face on which the fastener means 66 is provided.

The goal tending device 10 is also preferably provided with tie means 52*a* . . . *l*, which may comprise strips of hook-and-loop fastener sewn on or under, or adhered to, the reinforcement means 28, 36, 48*a*, 48*b*, and 48*c*, as well as to the skirt 16, in the case of tie means 52*a* and 52*l*. Cording or other means may be used in the place of hook-and-loop fastener, although hook-and-loop fastener provides for faster attachment and detachment when the goal tending device 10 is mounted on a goal 100, as shown in FIG. 4.

When the goal tending device 10 is mounted on a goal such as a hockey goal 100, with reference to FIG. 4, the upper edge of the goal tending device is first temporarily affixed to the crossbar 120 of the goal 100 by the tie means 52*e, f, g*, and *h*, and to the side posts 115, 120 by tie means 52*i*, 52*j*, 52*k*, and 52*l*, and 52*a*, 52*b*, 52*c*, and 52*d*. With the goal tending device 10 thus held in position vertically by the tie means, the tethering means 54*a* . . . *n* are then wrapped around the crossbar 110 and the posts 115, 120 and fastened by the fastening means 55*a* . . . *n* and 59*a* . . . *n*; the length of the tethering means 54*a* . . . *n* is then adjusted through the length adjustment means 57*a* . . . *n*, such that the goal tending device 10 is suspended from the goal 100 without appreciable sagging. The goal tending device 10 thus blocks portions of the goal area, providing only the target areas 20, 30, 40, 50, 60 as areas where goals may be scored by propelling a projectile therethrough. If a projectile strikes the goal tending device 10 without passing through a target area 20, 3, 40, 50, 60, then the impact of the projectile is partially absorbed by the flexible goal tending device 10, thus reducing the speed of any rebounding projectiles and the potential of injury from a deflected shot on goal. If a flap 80 is provided in the target area 20, 30, 40, 50, or 60, the projectile that achieves the target area 20, 30, 40, 50, or 60 will strike the flap 80 thus depending downward, and the impact with the flap 80 will decelerate the projectile, thus reducing the potential impact of the puck or other projectile against the goal net 110, or any body present behind the goal 100. Projectiles that slide or roll along the ground may be arrested by the skirt 16, if the skirt 16 is fastened to the posts 115, 120 on either side by the tie means 52*a*, 52*l*; the projectiles also may pass through the goal area by impacting and lifting the skirt 16, and passing beneath the reinforcement means 40*a*, 40*b*, or 40*c*. Thus, the height of the skirt 16 is preferably approximately the height of the projectile intended for use with the goal 100, or in any event preferably no higher than approximately twice the height of the intended projectile. The skirt 16 is generally used as an access window for retrieving projectiles that have passed through one of the target areas 20, 30, 40, 50, 60. As shown in FIG. 2, the rear surface of the goal tending device 10 is provided with further fastening means 52*m* and 52*n*, which may comprise mating portions of hook-and-loop fastener or similar fastening means. Fastening means 52*m* is provided along the rear surface of the skirt 16, preferably parallel to the edge of the skirt 16, and fastening means 52*n* is provided on the rear surface 14*b* of the goal tending device 10, also preferably parallel to the edge of the skirt 16, such that when the skirt 16 is folded up and towards the rear surface 14*b*, the fastening means 52*m* and 52*n* mate and the skirt 16 may be temporarily suspended to allow easy access to projectiles behind the goal tending device 10.

Figure 3A:
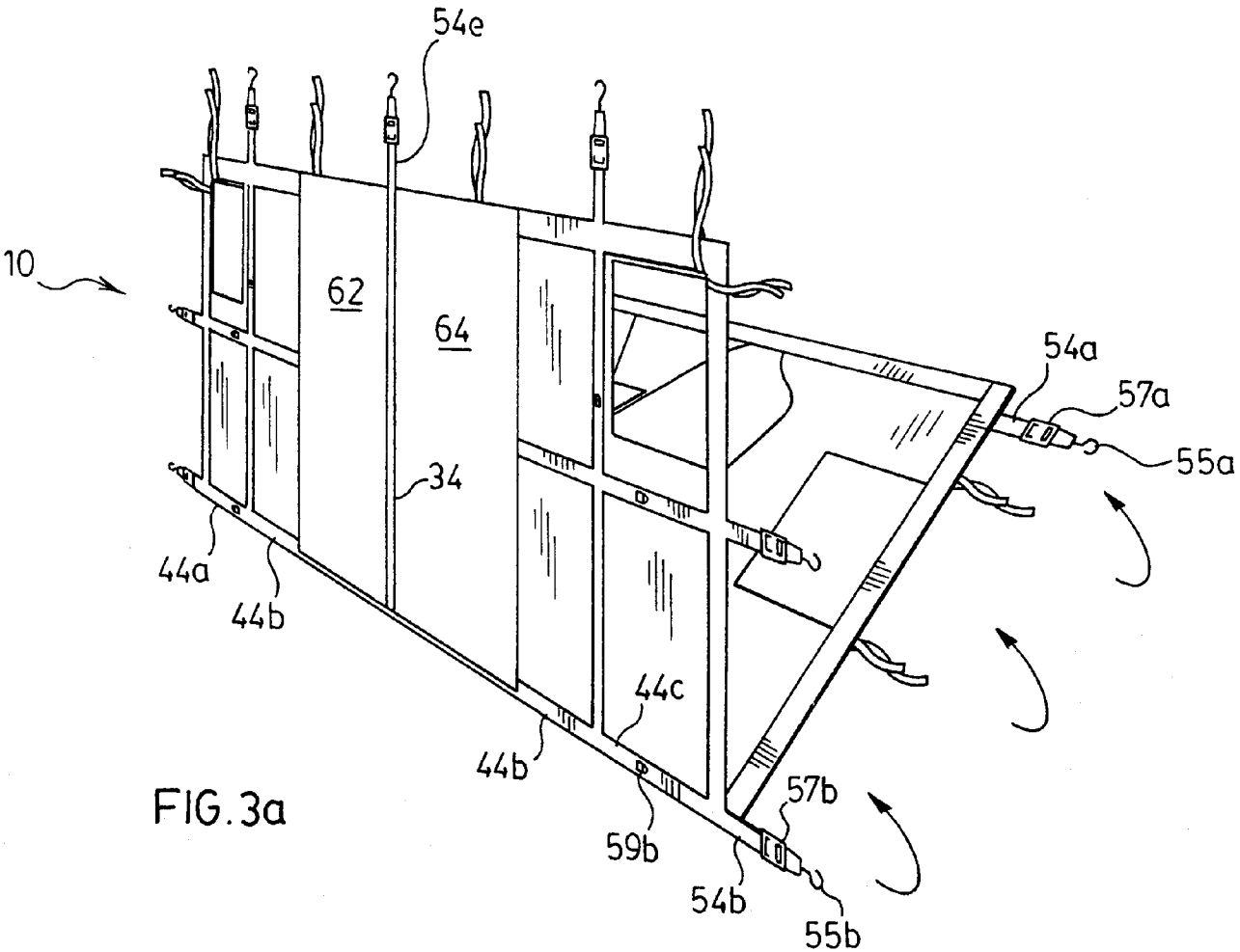
FIG. 3*a* is a first perspective view of a first step in stowing the goal tending device of FIG. 1.
Figure 3B:
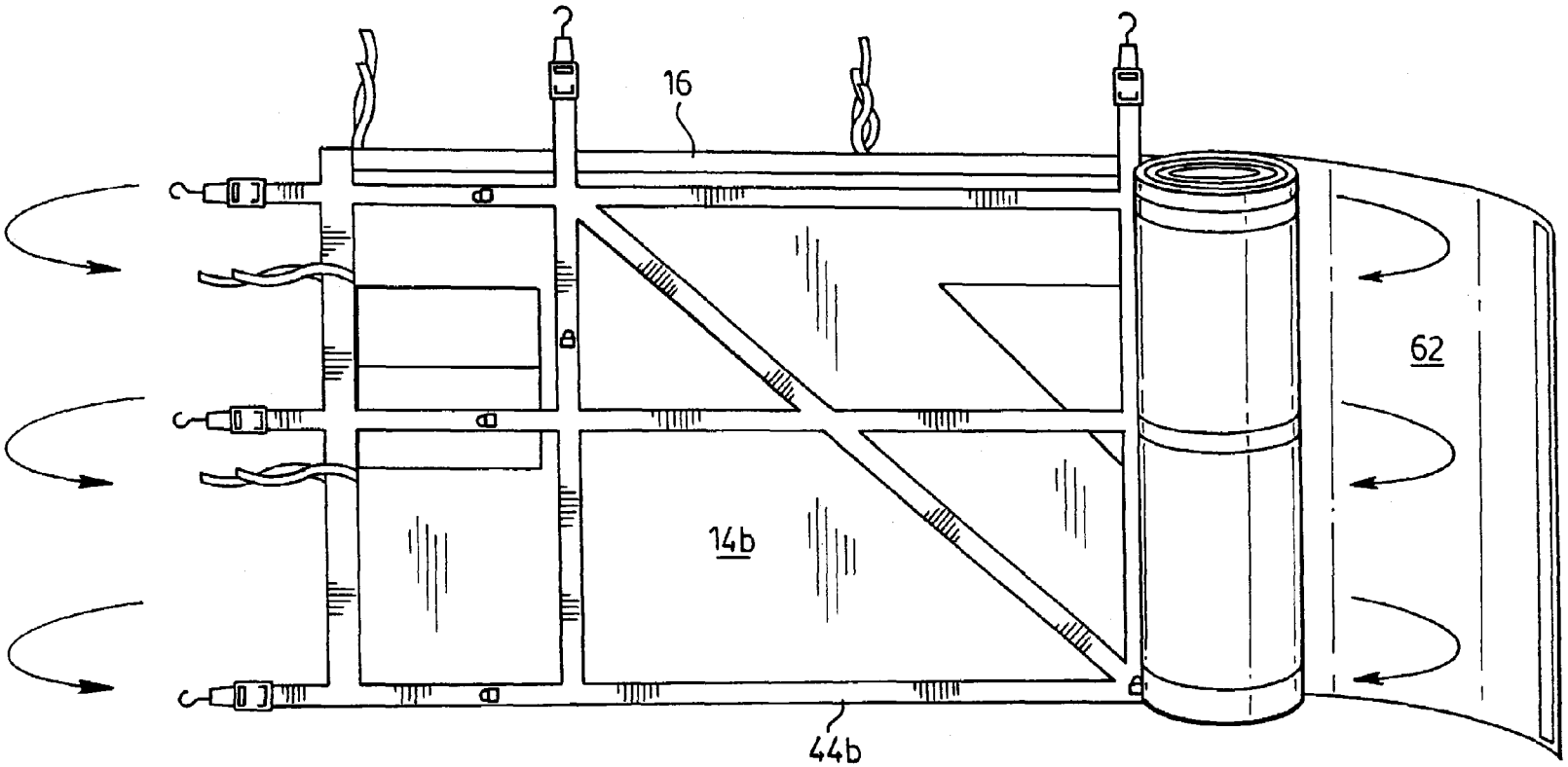
FIG. 3*b* is a second perspective view of a subsequent step in stowing the goal tending device of FIG. 1.
Figure 3C:
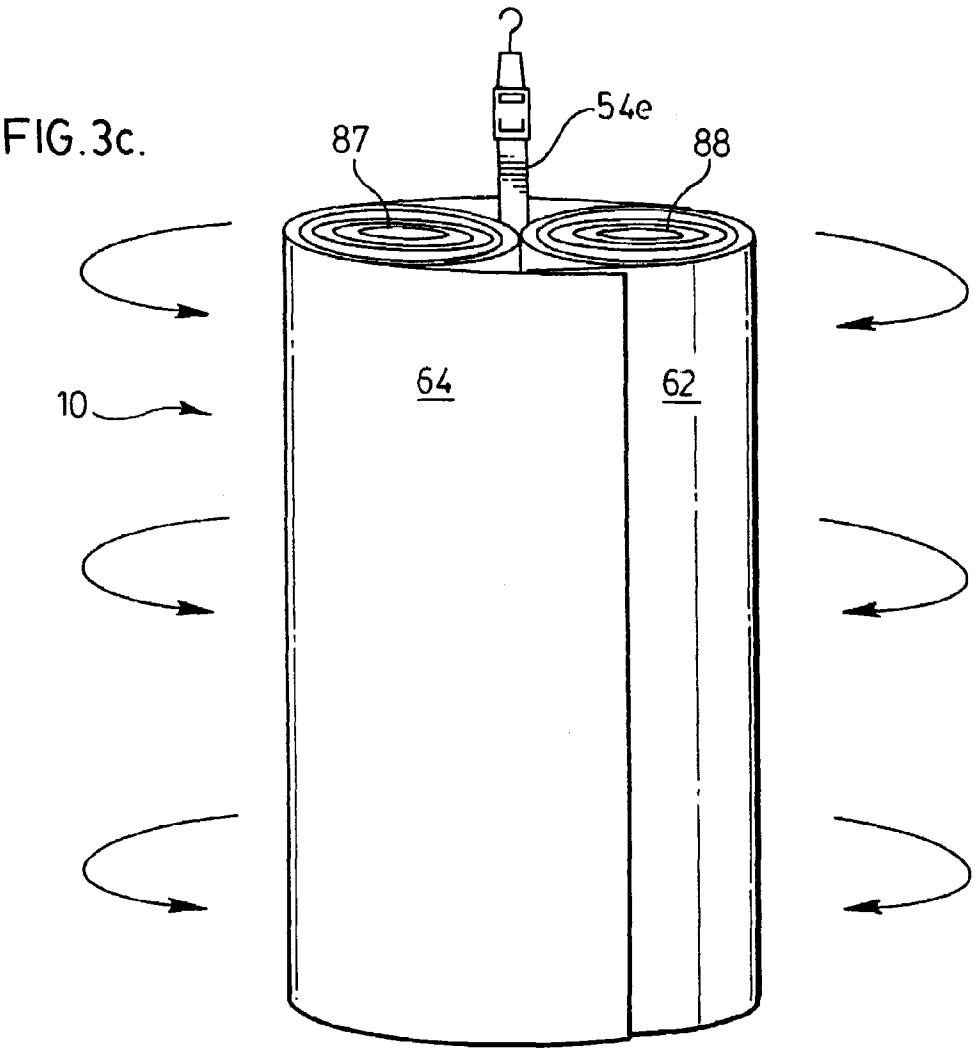
FIG. 3*c* is a third perspective view of yet another subsequent step in stowing the goal tending device of FIG. 1.
Figure 3D:
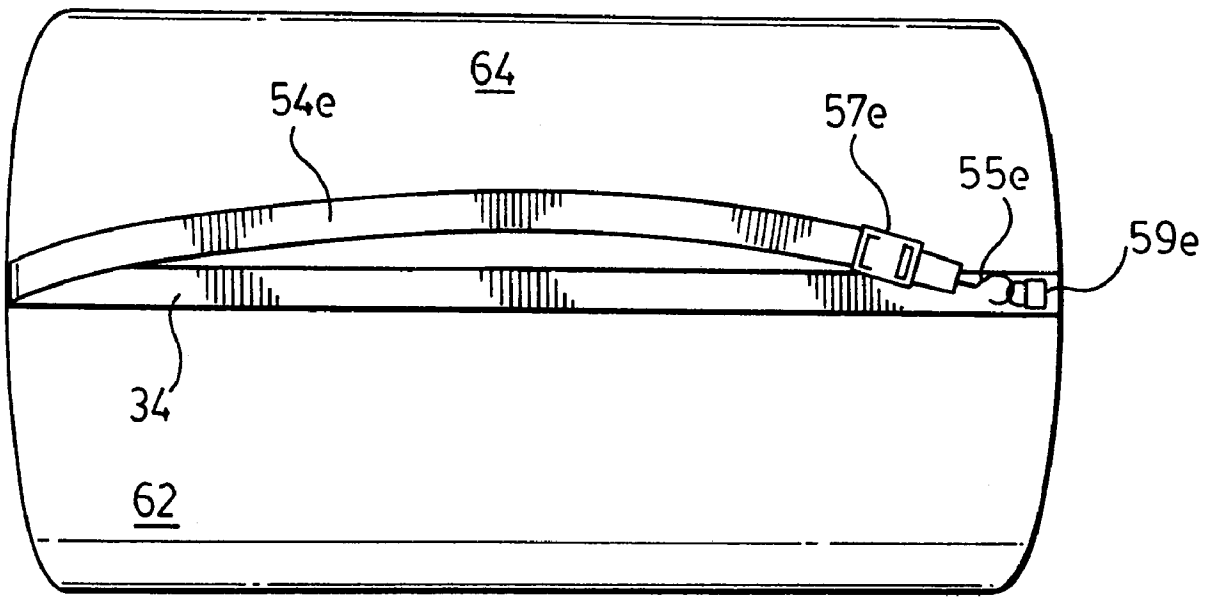
FIG. 3*d* is a fourth perspective view of yet another subsequent step in stowing the goal tending device of FIG. 1.

The goal tending device 10 may be stowed using the jacket means 62, 64. First, the device 10 is removed from the goal 100, if necessary, then folded with the front surface 12 on the inside as shown in FIG. 3*a*. If the reinforcement means 44*a*, 44*b*, 44*c* is aligned such that its edge is at the midsection of the goal tending device 10 as in the most preferred embodiment, then the device 10 may be folded at that edge. Next, the goal tending device 10 is coiled in a crosswise direction towards the center reinforcement means 34, as shown in FIG. 3*b* from either end, yielding two coiled portions 87, 88, as shown in FIG. 3*c*. The jacket means 62, 64 are then wrapped around the coiled portions 87, 88, and fastened together using the fastener means 66, 68. The goal tending device 10 may thereafter be transported in a secure package. The tethering means 54*e* may be passed over the jacket and its hook means 55*e* secured to the corresponding eye means 59*e* to provide a carrying strap, as shown in FIG. 3*d*.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. An apparatus for mounting on a goal, the goal comprising a crossbar and two posts, the apparatus comprising:

a panel having a front surface, a rear surface and an outer perimeter, the panel comprising at least one target area, wherein the at least one target area comprises an area to admit passage of a projectile;

a plurality of tethering means extending from the perimeter of the panel;

a plurality of reinforcement means disposed on the rear surface of the panel, wherein the reinforcement means are arranged to define a network of reinforcement means on the rear surface of the panel, and at least a portion of the reinforcement means are connected to the tethering means, further comprising first and second jacket means disposed along an axis of the apparatus, each of the jacket means comprising a fastening means along an edge thereof, such that when the apparatus is coiled into a substantially scroll-like form, each of the jacket means is adapted to wrap around its portion of the substantially scroll-like form such that the edges are joined by the fastening means.

2. The apparatus of claim 1, wherein the network of reinforcement means is disposed such that at least one reinforcement means frames at least one target area.

3. The apparatus of claim 2, wherein the at least one target area comprises at least one straight edge, and at least one reinforcement means is substantially parallel and proximal to the at least one straight edge.

4. The apparatus of claim 3, wherein the panel is substantially rectangular and the apparatus comprises four target areas disposed proximal to four corners of the panel.

5. The apparatus of claim 4, wherein the apparatus further comprises a further target area disposed in a central portion of the panel.

6. The apparatus of claim 5, wherein the further target area is substantially triangular, wherein one side of the further target area is substantially parallel and proximal to an edge of the panel.

7. The apparatus of claim 1, wherein the plurality of tethering means comprises a plurality of strap means for mounting the apparatus to the goal.

8. The apparatus of claim 7, wherein the plurality of tethering means further comprises a plurality of hook and loop fastener means for mounting the apparatus to the goal.

9. The apparatus of claim 7, wherein each of the plurality of strap means comprises a first attachment means fixed near a first end of the strap means, and a mating second attachment means fixed near a second end of the strap means, such that the apparatus is mounted on the goal by extending the strap means around a crossbar or post of the goal and mating the first and second attachment means.

10. The apparatus of claim 9, wherein each of the plurality of strap means is integral with one of the plurality of reinforcement means.

11. The apparatus of claim 10, wherein the mating second attachment means on the strap means is fixed on the reinforcement means integral with the strap means.

12. The apparatus of claim 7, wherein each of the plurality of strap means further comprises a length adjustment means.

13. The apparatus of claim 1, wherein the first and second jacket means extends along half the length of the apparatus parallel to the axis.

14. The apparatus of claim 1, wherein one of the plurality of tethering means is disposed collinearly with the axis.

* * * * *